United States Patent [19]

Bordini

[11] Patent Number: 4,759,695

[45] Date of Patent: Jul. 26, 1988

[54] PUMPING UNIT FOR THE FILLING OF CONTAINER IN PACKAGING MACHINES

[75] Inventor: Giorgio Bordini, S. Prospero, Italy

[73] Assignee: Tetra Dev.-Co., Modena, Italy

[21] Appl. No.: 942,766

[22] Filed: Dec. 17, 1986

[30] Foreign Application Priority Data

Dec. 18, 1985 [IT] Italy ..... 23253 A/85

[51] Int. Cl.[4] ..... F04B 7/00; F04B 39/08; B67D 1/10

[52] U.S. Cl. ..... 417/519; 222/148; 417/454

[58] Field of Search ..... 417/DIG. 1, 519, 454; 137/625.43; 222/148

[56] References Cited

U.S. PATENT DOCUMENTS

| | | | |
|---|---|---|---|
| 1,831,411 | 11/1931 | Dietz | 417/DIG. 1 |
| 1,897,302 | 2/1933 | Crimmel | 137/625.42 |
| 2,786,425 | 3/1957 | Yarbrough | 92/171 |
| 3,694,112 | 9/1972 | Freedman | 417/519 |
| 3,741,691 | 6/1973 | Schwing | 417/579 |
| 3,874,825 | 4/1975 | Jentsch | 417/519 |
| 4,008,012 | 2/1977 | Page | 417/454 |
| 4,358,257 | 11/1982 | Seiler | 417/519 |
| 4,431,334 | 2/1984 | Walser | 417/519 |
| 4,540,015 | 9/1985 | Henriksen | 222/148 |
| 4,576,557 | 3/1986 | Pevzner | 417/454 |

FOREIGN PATENT DOCUMENTS

| | | | |
|---|---|---|---|
| 1139286 | 11/1962 | Fed. Rep. of Germany | 417/519 |

*Primary Examiner*—William L. Freeh

*Attorney, Agent, or Firm*—Burns, Doane, Swecker & Mathis

[57] ABSTRACT

A pumping unit for the filling of containers in packaging machines, in particular of foodstuffs with fluid behavior with the presence of suspended particles, which allows reliable operation under aseptic conditions, and which is easily cleanable. The conical shutter of the pumping unit, selectively connecting the pumping piston to the product intake duct and to the product delivery duct, is movable backwards from its seat, so as to allow an easy and reliable cleaning of unit's body, with no danger of product deposit with consequent loss of aseptic conditions.

9 Claims, 2 Drawing Sheets

PUMPING UNIT FOR THE FILLING OF CONTAINER IN PACKAGING MACHINES

FIELD OF THE INVENTION

The present invention relates in general to a pumping unit for the filling of containers in packaging machines, and in particular to a pumping unit for the filling of containers of products with fluid behaviour under aseptic conditions.

BACKGROUND OF THE INVENTION

Aseptic automatic packaging machines are used in the packaging of products with fluid behaviour, such as more or less hard particles of a certain size in suspension in a liquid, inside packaging containers of the disposable type. These machines are connected by means of a pipe to units for the processing and the conveyance of the contents to the machine. A pumping unit is typically provided to secure that a uniform and predetermined volume per time unit of products to be packaged flows into the individual container being formed from a tube of packaging material. This pumping unit may be, e.g., a metering pump, which at each cycle distributes the desired and predetermined amount of contents. The hygienic requirements imposed to such a pumping unit are very severe, as the packaging machine is of the aseptic type, i.e., it produces packages which must be filled with contents which have previously undergone a operation to make them sterile.

These requirements are important since the particles contained inside the product can be portions of vegetables, fish, meat and other solid or semi-solid foodstuffs are particularly dangerous if they are not stored under conditions of absolute sterility.

Known pumping units caused many problems for the packaging machine, in that the complete cleaning thereof inside the packaging plant was difficult, and they were hence the staring point for the diffusion of non-aseptic conditions. Their particular structure on one hand created an obstacle to the centralized washing of the packaging machine, and on the other was the starting point for infiltrations from the outside, by not being provided with sufficient aseptic barriers, or showing portions which during the operation process could come into connection, even if minimum, with the non-aseptic outer environment.

Moreover, the particular masses of the pumping body or piston absorbed heat, e.g., during the step of sterilization and washing with superheated steam, which they had a certain difficulty in losing before the restarting of the production and filling cycle.

Not least of the problems was that of a quite obliged positioning thereof relative to the packaging unit of the packaging machine, with some consequent unbalancing or lack in tightness in the subsequent production step due to vibrations, sudden temperature changes, wear of components, with serious difficulties both as for the restoration of the exact matching contacts between the surfaces, and as for the necessary clearances.

OBJECTS AND SUMMARY OF THE INVENTION

One object of the present invention is to provide a pumping unit, in particular for the treatment of product with fluid behaviour, solving the whole series of the above exposed operation and maintenance and adjustment problems, thus allowing a more perfectly aseptic production cycle, and an always constant cyclic feed of the product.

These objects according to the present invention are achieved by providing a pumping unit for the filling of containers generated in packaging machines, positioned to intercept a feed duct and a duct for the delivery of the product to be packaged which is of the type with fluid behaviour, essentially comprising a hollow pump body individuating inside its interior a chamber composed by a first cylinder-like portion, containing a sliding pumping piston, and by a conical portion, inside of which a hollow conical shutter is rotatably contained, suitable to selectively connect said feed and delivery ducts positioned in correspondence of said conical portion with said first cylinder-like section, characterized in that said conical shutter is additionally axially translatable relatively to said conical portion, so as to connect both said feed and delivery ducts and said conical portion of said hollow body, a means driving said translational motion being provided.

BRIEF DESCRIPTION OF THE DRAWINGS

The structural and functional characteristics and the advantages of a pumping unit according to the present invention shall be better understood from the following exemplifying disclosure referred to the related schematic drawings, wherein.

DETAILED DESCRIPTION OF A PREFERRED EMBODIMENT

Figure 1:
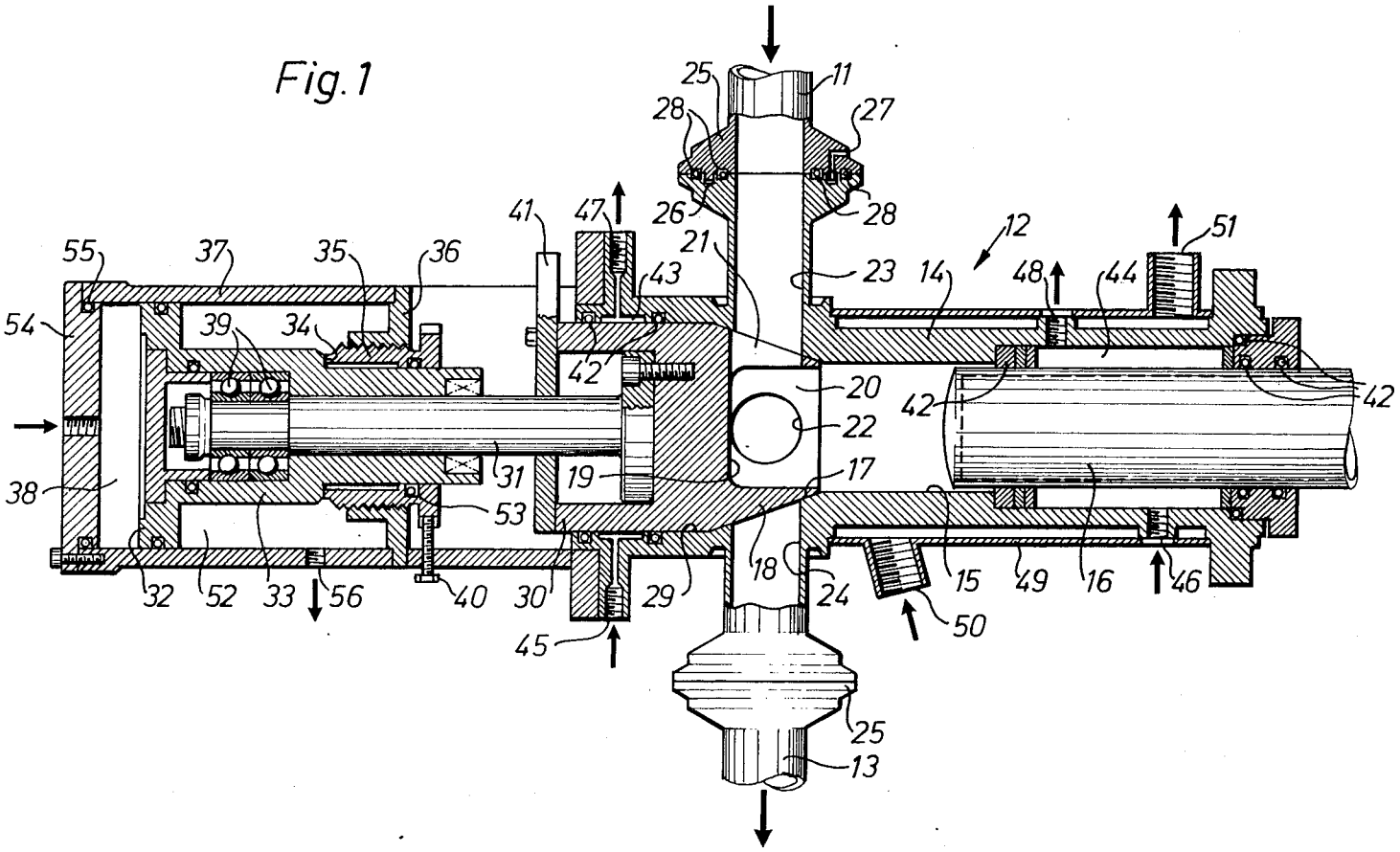
FIG. 1 is a cutaway view of a pumping unit according to the invention in an operative stage.

Referring to the figures, in a machine (not shown) for the packaging of products with fluid behaviour, in particular composed by particles in suspension inside a liquid, a feed duct 11 supplies the product to a pumping unit according to the invention and indicated with 12, which delivers it into a delivery duct 13, which enters inside a tube of packaging material (not shown), from which in a known way the individual filled package is being manufactured.

Of course, the entire feeding and packaging operation is carried out under aseptic conditions, to preserve the integrity and the good quality of the foodstuff, and to guarantee the characteristics with time.

The pumping unit according to the invention is, in the example shown, a single-cylinder reciprocating metering pump comprising an outer body 14 inside which a chamber is provided, essentially composed by a first cylinder-like hollow portion 15, suitable to receive a pumping piston 16, connected to a hollow conical central portion 17, extending from said first cylinder-like portion 15.

The hollow conical portion or seat 17 receives a conical shutter 18, within which a front chamber 19 is recessed, provided with a first axial bore 20, suitable to communicate with the cylinder-like portion 15, and with two radial bores 21 and 22 shifted 90° from each other, and selectively connectable by rotation to a feed inlet 23 and to a delivery outlet 24 provided and radially open outwards on the body 14.

The feed inlet 23 and the delivery outlet 24 are connected to the related intake duct 11 and delivery duct 13 by means of pairs of flanges 25 provided with an annular male-female coupling 26, fed by aseptic steam in 27 and positioned between concentric outer and inner annular seats 28, wherein related sealing rings are placed.

The conical shutter 18 extends rearwardly and axially into a cylindrical portion 30 sliding inside a second hollow cylindical portion 29 of the outer body 14, the portion 30 being in its turn hollow and containing the stem 31 of a piston 32 solidly fastened to it. The other end of the stem 31 is supported inside a sleeve 33 extending from piston 32 through orientatable thrust bearings 39 and the sleeve 33 is provided with a recessed annular seat 34 acting as stop shoulder against the basis of a ring nut 35. The ring nut 35, externally threaded, can be screwed down and adjusted in axial position relatively to the stem 31 on a sleeve 36 provided with an inner complementary thread, and fastended on to an outer cylinder 37 within which the piston 32 can slide by means of air fed to the rear chamber 38.

A bottom 54 closes the cylinder 37 at the other end and is provided with sealing gaskets 55.

The piston 32, the cylinder 37 and the sleeve 36 define a chamber 52 which is fed with air through a bore 56 to actuate the return of piston 32 from its natural operative position and the disconnection of the conical shutter 18 from the conical seat 17.

In view thereof, sealing gaskets 53 positioned inside the ring nut 35 and acting on the sleeve 33 are provided.

A means is thus provided to actuate the translation of said shutter, in the specific case a double-effect cylinder, which is provided with piston stroke adjusting means.

The ring nut 35 can be locked in the proper selected position by means of a screw 40 radial relatively to the cylinder 37.

The end of the cylindrical portion 30 of the conical shutter 18 receives a lever 41 driving the rotation of the same conical shutter 18 between the two functional positions of connection of the cylinder 15 with the feed inlet 23 and the delivery outlet 24 by means of the radial bores 21 and 22, open one at a time, and by means of the axial bore 20.

Externally on the cylindrical portion 30 and on the piston 16, in a zone provided beyond and inside sealing gaskets 42, an aseptic sterile barrier is created by introducing and circulating inside respective annular chambers 43 and 44, e.g., sterile steam or condensate, through respective inlet ducts 45 and 46 and outlet ducts 47 and 48.

Around the first hollow cylindrical portion 15 of the outer body 14 a cylindrical jacket 49 is installed, provided with inlet duct 50 and outlet duct 51, inside which jacket a controlled-temperature fluid or liquid is circulated, so as to determine the quick cooling or heating of the big mass constituting the pumping piston 16.

As it can be observed and better understood from the figures, both the pumping piston 16 inside the first hollow cylindrical portion 15 and the cylindrical portion 30 of the conical shutter 18 inside the second hollow cylindrical portion 10 of the body 14, show a certain clearance which guarantees, besides a safe positioning and sliding, also an extreme cleaning easiness.

Figure 2:
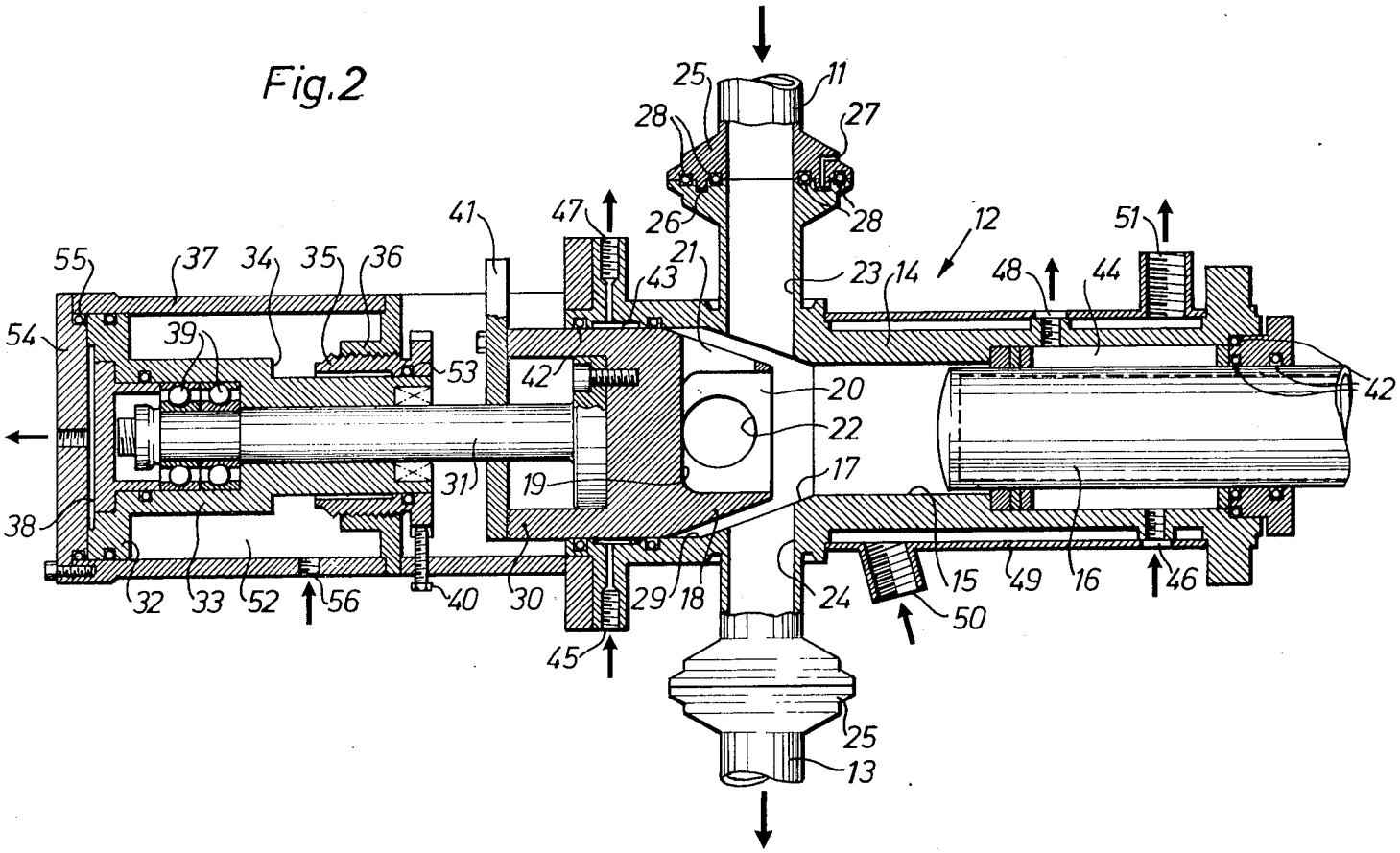
FIG. 2 is a cutaway view similar to that of FIG. 1, in a washing stage.

The diameter of the first hollow cylindrical portion 15 lower than the lower diameter of the hollow conical portion 17 allows eliminating any deposits of product, besides allowing a safe washing when the conical shutter 18 is in its rearwards position (FIG. 2) because of the inlet of sterile steam or condensate under high pressure.

In fact, a pumping unit or metering pump 12 according to the invention, once installed between the intake duct 11 and the delivery duct 13, positioned as in FIG. 1, receives the product through the feed inlet 23. The product passes then into the radial bore 21 and through the axial bore 20 it goes to fill the first hollow cylindrical portion 15, the piston 16 being in its backwards position.

The radial bore 22 is closed in this stage against the wall of the hollow conical portion 17. Through the lever 41 only the rotation of the conical shutter 18 is determined, so as to shut the feed inlet 23 by moving the radial bore 22 in correspondence of the delivery outlet 24.

The pumping piston 16 advances so as to push and feed the product to the container, not shown. The previous cycle of again feeding the product to the pumping unit, and from there to the container over the whole production cycle is repeated. If during the production cycle any loss of the aseptic conditions occurs, or if the production is at its end, the whole packaging equipment must be washed and made sterile again.

To that purpose, after having stopped the flow of the product, air is introduced through the bore 56. The thrust of air present in the chamber 52 causes the piston 32 and consequently the conical shutter 18 solid with it to move backwards. This causes the feed duct 11 and the delivery duct 13, the conical portion 17 of the chamber 19 and the first cylindrical portion 15 to come into communication, so that all concerned portions are completely washed and sterilized.

Then, washing liquid and/or subsequently high-pressure sterilization steam or condensate is introduced. To guarantee that occurrence, according to the invention both the outer pump body 14 and the conical shutter 18 have been made as monolithic pieces without interstices or joints in the mutual facing portions comprise between the intake inlet 23 and the delivery outlet 24 and the annular chambers 43 and 44 embodying the aseptic barriers.

Once the pumping unit has been washed, and its aseptic conditions have been restored, the conical shutter 18 is positioned again against the stop shoulder in its complementary seat 17 by supplying air into the chamber 38.

It is possible to intervene to adjust the stroke while not damaging or recalibrating the conical coupling, by removing the lock screw 40 and acting on the ring nut 35, so as to displace the position of stop and end of stroke of piston 32, or, better of the annular seat 34 of sleeve 33. After having obtained the desired adjustment, the ring nut 35 is locked again by means of the screw 40. In view of that, it is useful that the interacting threads of ring nut 35 and of sleeve 36 be of the fine pitch type, so as to allow micrometric adjustments.

Both in the adjustment step and in the step of positioning of the conical shutter 18 in its seat 17, the presence results moreover particularly useful of the orientatable thrust bearing 39, together with the coupling clearance between the second cylindrical portion 29 of the pump body 14 and the cylindrical portion 30 of the conical shutter 18. In fact, a self-centering of the shutter is so allowed, even if precise and congruent tolerances between the components, or between their portions which come sequentially into contacts do not exist.

Advantageously, according to a preferred embodiment of the present invention, the inclination angle of the conical coupling shall be around 20°, and the material constituting the conical shutter 18 shall be a ceramic material, with the drive stem 31 of steel having a helical outline, for a better mutual constraint with the ceramic material obtained, e.g., by means of a resin such as araldite, allowing an essentially flexible coupling, and a better sealing between the surfaces in mutual engagement.

While the invention has been illustrated and described in accordance with a preferred embodiment, it is recognized that variations and changes may be made and equivalents employed herein without departing from the invention as set forth in the claims.

What is claimed is:

1. A pumping apparatus for filling containers with a product possessing a fluid behavior comprising:

a feed duct, a delivery duct, a hollow pump body individuating therein a chamber having a first and second cylindrical portions, said first containing a slidable pumping piston and a conical portion rotatably supporting a conical hollow shutter, said conical hollow shutter being rotatable to connect said feed duct and said delivery duct with said first cylindrical portion, said conical hollow shutter being axially translatable relative to said conical portion to connect said feed duct with said delivery duct and to expose said conical portion to said ducts, said second cylindrical portion being located adjacent said conical portion and drive means for axially translating said conical hollow shutter relative to said conical portion, said drive means including a double-effect cylinder connected with said hollow body pump, and further having a piston received in said cylinder, a stem connected between said piston and said conical hollow shutter and means for adjusting the stroke of said piston in said cylinder.

2. The pumping apparatus according to claim 1, wherein a jacket is provided externally of said first cylindrical portion, said jacket being adapted to receive a controlled temperature fluid therein.

3. The pumping apparatus according to claim 1, wherein said feed and delivery ducts are connected to inlet and outlet ducts through flanged connections having aseptic seal chambers therein.

4. The pumping apparatus according to claim 1, wherein said conical hollow shutter is self-centering relative to said conical portion and said conical hollow shutter is connected to said drive means through an end element which is orientable relative to said drive means.

5. The pumping apparatus according to claim 1, wherein the end of said conical portion which is remote from said first cylindrical portion has a diameter at least as large as the diameter of said first cylindrical portion.

6. The pumping apparatus according to claim 1, wherein said conical hollow shutter is formed of a ceramic material and is connected to said drive means through a flexible coupling.

7. The pumping apparatus according to claim 1, wherein said hollow conical shutter includes a third cylindrical portion extending axially rearwardly therefrom relative to said conical portion, said drive means being constrained to said third cylindrical portion, wherein said third cylindrical portion is slidably supported in said second cylindrical portion, a first aseptic sealing chamber between said first cylindrical portion and said pumping piston and a second aseptic sealing chamber between said second and third cylindrical portions.

8. The pumping apparatus according to claim 7, wherein said first cylindrical portion, said conical portion and said second cylindrical portion are formed as a single piece of material.

9. The pumping apparatus according to claim 7, wherein said conical hollow shutter and said third cylindrical portion are formed as a single piece of material.

* * * * *